United States Patent [19]

Henningsson

[11] Patent Number: 4,626,465

[45] Date of Patent: Dec. 2, 1986

[54] CURTAIN FABRICS FOR GREENHOUSES AND SHADE HALLS

[75] Inventor: Göran Henningsson, Kinna, Sweden

[73] Assignee: Ludwig Svensson International B.V., Zuidland, Netherlands

[21] Appl. No.: 809,790

[22] Filed: Dec. 17, 1985

Related U.S. Application Data

[63] Continuation-in-part of Ser. No. 629,822, Jul. 3, 1984.

[51] Int. Cl.[4] ..... D03D 3/00

[52] U.S. Cl. ..... 428/225; 66/192; 66/193; 66/202; 428/229; 428/253; 428/263

[58] Field of Search ..... 66/192, 193, 202, 85 R; 428/253, 257, 225, 229, 263

[56] References Cited

U.S. PATENT DOCUMENTS

| | | | |
|---|---|---|---|
| 2,836,529 | 5/1958 | Morris | 428/257 |
| 3,567,565 | 3/1971 | Jones et al. | 66/202 |
| 4,183,993 | 3/1980 | Benstead | 428/253 |
| 4,399,671 | 8/1983 | Henningsson | 66/202 |
| 4,425,398 | 1/1984 | Benzi | 428/253 |
| 4,434,200 | 2/1984 | Flash et al. | 428/257 |

*Primary Examiner*—James J. Bell

*Attorney, Agent, or Firm*—Holman & Stern

[57] ABSTRACT

Curtain fabrics for use as greenhouse curtains or shading fabrics comprise strips of metal foil incorporated in a yarn network having longitudinal and transverse connection threads. Transverse threads on the other side of the fabric extend between adjacent strips for connection to the longitudinal threads. In the case of greenhouse curtain the strips are situated between each adjacent pair of longitudinal connection threads while in the case of a shading fabric the strips are more widely spaced so as to provide ventillation spaces therebetween.

16 Claims, 6 Drawing Figures

CURTAIN FABRICS FOR GREENHOUSES AND SHADE HALLS

CROSS-REFERENCE TO RELATED APPLICATION

This application is a continuation in part of application Ser. No. 629,822 filed July 3, 1984.

FIELD OF THE INVENTION

This invention relates to curtain fabrics for greenhouses, shade halls or the like, and which comprises strips of a flexible material such as foil strips, which are connected together in a yarn framework by means of textile threads.

BACKGROUND OF THE INVENTION

Curtains have been used as shading means in greenhouses and shade halls for a number of years. The green-house curtain, even called the shading web, has replaced this previous common lime painting of the glass surfaces of the green-house, but has also involved other advantages. Thus it can be assured that the fall of cold which occurs when the ventilator doors are opened is eliminated and a continuous ventilation and heat distribution is obtained. Besides, the shading fabric stops the sun shine which is let in through the open ventilator doors. As a result of this the supplying of nutritive liquid to the plants cultivation can be kept more regular and at a lower level, at the same time as the difficult and risky job with the lime painting of the glass surfaces and the removal of the paint can be completely eliminated. It is also important that the greenhouse curtain is movable, i.e. that it is rollable and drapable, so that in a simple way it can be pulled across or aside for regulating the inlet of light, at the same time as when it is rolled up or draped does not require any considerable space.

The high costs for heating green-houses have enforced demands for a better heating insulation, and these wall linings with different type of foils alone or together with ceiling covering of a shading web, which are used up to now, gave almost unassuming heat savings. This mainly depends on the fact that the insulating efficiency of these materials are low.

Insulating is needed on different situations.

(a) for strong radiation of sun (field of wave lengths 300–2.800), (b) for low radiation during cold days to get a "positive balance of energy", i.e. the losses of heat are much higher than the profits of radiation during day time (windy, cloudy and cold days), (c) the convection losses at night, (d) heat losses by radiation at nights (e) ventilating losses at night (f) condensation losses at night (g) combination of the above To manage the above demands conventional textile material are not sufficient.

It is necessary to on one hand use materials which are transparent and/or reflecting for sun light and on the other hand materials which are highly reflecting or low emitting for long wave radiation. The combination of these qualities is not found in textile materials, but in foils.

A foil is however not suitable for the purpose since it is diffusion proof, gathers water pockets, fractures, decays by sun light and is very stiff for being/draped, which is the established way to apply the fabric in a green-house. Condensing drops are besides formed on the inside, which can not be allowed.

The DE-A-No.2835375 describes a crocheted fabric consisting of a net like yarn structure, in the open net loops of which are laid strips of a flexible material, for example plastic foil strips. The purpose of this technique is to achieve a greater richness of variation as regards the pattern of the fabric. Thus it is possible to use foil paths with imprinted patterns which before the introduction into the crocheted goods are cut out to strips, so that the completed goods shows the same pattern as the foil path, but optically is open-worked by the textile threads. Such a crocheted article suits for decoration purposes, such as for curtains in which the main purposes is to be decorative, but can not be used as greenhouse curtains, since the foil strips are arranged with relatively large spaces therebetween and therefore would allow convectional air streams, radiation and condensing water to pass through the fabric. Furthermore, the connection between the foil strips and the textile connecting threads is not such that the relatively smooth strips are fixed against displacement.

Through the Swedish patent publication No. 8001544-9 it is known to design a green-house curtain as an insulating fabric, which between the double parallel textile paths strips of a heat radiation reflective material have been placed. This double insulating fabric has certainly a very good insulating effect and reflecting efficiency, but as it requires double textile paths, which through a special arrangement are connected with each other, the manufacturing price becomes relatively high at the same time as the double paths at the rolling, draping or bringing together sideways requires a relatively large space.

It is also known through the Swiss Pat. No. 138000 to use metal foil strips for textile purposes, said strips being used in order to bring about effects of applied industrial art, such as through using the strips in twisted form or through wrapping up them about a yarn.

As for shade halls, these are used in warm countries (tropical to Mediterranean climates), in which plants are protected against strong solar radiation but convectional air streams are permitted to pass through the walls. The most primitive shade halls are built by spaced boards or bamboos. There are also known shading fabrics intended to be placed on a frame structure, said shading fabrics being made of black plastic material. The black material prevents the solar radiation from reaching the plants by absorbing it and converting it into heat radiation. This means that the temperature in the shade hall during the daytime will be high, which could be injurious to the plants. During night-time, the black material will emit much heat radiation out of the shade hall, so that the temperature therein will be low.

In French patent publication No. 2.071.064 there is disclosed a fabric which can be used for shading of plants. It is a woven fabric, in which some of the warp threads consist of flat yarns, which could have absorption and/or reflection ability. There are also other warp threads in order to provide a suitable distance between the warp threads so that a perforated fabric is obtained. All threads in the fabric are made of synthetic materials, such as polyethylene, propolyene, polyvinyl and the like. The yarn framework disclosed in this publication, however, would not be suited for providing fixation of "slippery" foil strips therein.

SUMMARY OF THE INVENTION

One object of the present invention is to provide a green-house curtain, which should fulfill the following demands:

(a) it should be drapable and rollable in both direction of the material path.

(b) it should be substantially tight against thermal air flows, but water-transmitting, so that no water gathering occurs if the green-house curtain is arranged horizontally.

(c) it should be able to be manufactured in very large widths for example 6 meters without seams.

(d) it should release a certain amount of water vapour.

(e) it should be durable against mechanical damage as well as UV-decomposition.

(f) it should be able to be manufactured in several alternative designs, such as, high reflective low emitting, transparent, semitransparent, for certain radiation (through for example metalizing).

(g) it should be able to be made two-sided, i.e. having a textile property on one side, for example the under side, and a non-textile property on the othr side, the upper side, so that the underside can bind the condensing water and the upper side can reflect solar radiation.

(h) the strips should be bound together and safely fixed in a stable yarn framework.

Another object of the invention is to provide a curtain fabric of similar structure to the fabric used as a greenhouse curtain, but which is more suitable as a shading fabric for use in shade halls.

A green house curtain in accordance with the invention is of the kind mentioned in the introduction wherein the strips at least partly consists of a low-emitting material and/or a material which reflects and/or absorbs heat radiation, that the width of the strips corresponds to the space between the connecting threads in the longitudinal direction of the material, i.e. the mesh staples, so that the strips are located side by side closely to each other with only the longitudinal connection threads between them, forming an essentially unbroken connected surface, that the longitudinal connection threads are located only on one side of a plane containing the strips, and that there are respective transverse connection threads located on opposite sides of said plane so as to extend respectively across opposite surfaces of the strips, the transverse threads on the other side of said plane extending through the spaces between adjacent strips for connection to the longitudinal threads. Preferably, the textile threads consist of a material which, by influence of heat, is shrinkable and through capillary effect is damp-keeping, and that the strips are thermo-mechanically fixed to the yarn framework formed by the textile threads.

Thus, in the greenhouse curtain fabric in accordance with the invention, the strips may be incorporated in a yarn framework between each pair of longitudinal connection threads. A shading fabric in accordance with the invention comprises foil or like strips bound together in a yarn framework in similar manner as in the greenhouse curtain fabric. Shading fabrics, however, are distinguished from the greenhouse curtain fabrics insofar as the strips are not arranged in each interval between adjacent rows of longitudinal connection threads as in the greenhouse curtain fabrics. Rather, in the shading fabrics, the part of the fabric covered by the strips can vary so that there are strip-free gaps left between certain adjacent pairs of longitudinal connection threads to allow ventilation and a certain amount of solar radiation to reach plants in a shade hall.

The preferably metallic foil strips reflect both heat radiation and solar radiation, which means that the temperature in a shade hall is kept as low as possible in daytime and as high as possible in night time. No plastic matrial is known which is capable of reflecting heat radiation.

DESCRIPTION OF PREFERRED EMBODIMENTS

Figure 1:
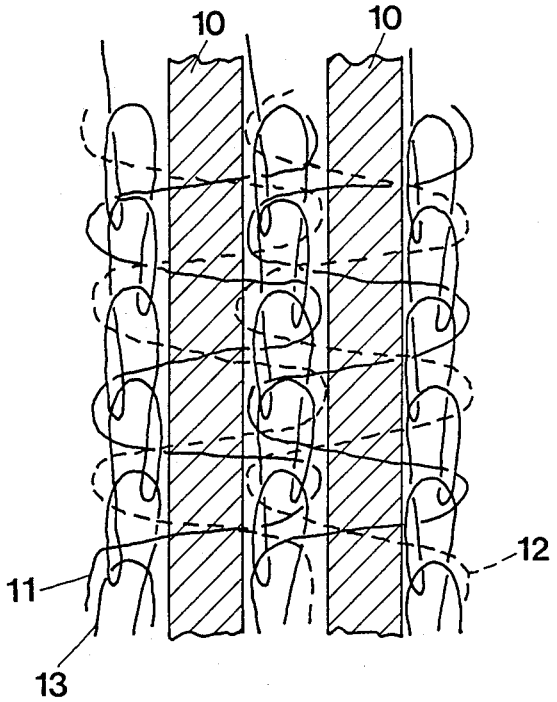
FIG. 1 shows on an enlarged scale, a mesh pattern of a crocheted fabric according to the invention suitable for use as a greenhouse curtain in which, for clarity, the space between the strips is greatly exaggerated.

A greenhouse curtain fabric according to the invention consists of a number of narrow foil strips 10, which are connected by textile threads. The foil strips are arranged closely edge to edge, so that they form an essentially connected surface. In the embodiment shown in FIGS. 1 and 2 the foil strips 10 are connected to each other through a knitting procedure. FIG. 1 shows the mesh pattern for a fabric manufactured through warp knitting at which four guide bars are used, one for the foil strips 10, two for the transverse these extending connection threads 11, 12 and the fourth for the longitudinal connection threads 13.

The space between the foil strips 10 have been exaggerated strongly in order to make the mesh pattern clear. In reality the above mentioned foil strips 10 are located closely edge to edge. The longitudinal connection threads 13 are arranged on the one side of the fabric, the under side, while the transverse threads are located on both sides of the fabric, the upper and the under side. The connection between the longitudinal and the transverse threads are made on the under side of the fabric, as it appears from FIG. 2. The foil strips can by that be put closely edge to edge and the unbroken connected surface on the upper side of the fabric becomes as large as possible.

Figure 3:
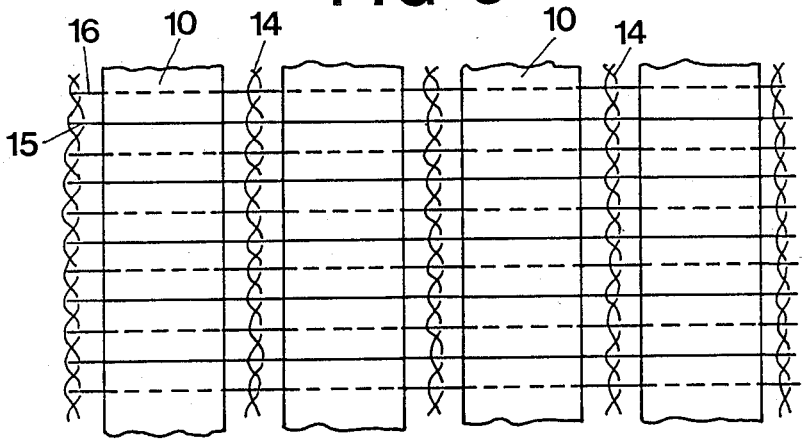
FIG. 3 shows on an enlarged scale a fabric according to the invention manufactured through a weaving procedure.

FIG. 3 shows a woven fabric, where the foil strips 10 makes the wrap reinforced with an extra textile warp thread 14 under the strips. The weft is made by textile threads 15, 16, which preferably extend in loop connection. Also here has for the sake of clarity the space between the foil strips 10 been strongly exaggerated. The weft threads 15 extending on the upper side of the fabric can be thinner than those on the under side and made of a transparent material.

The foil strips 10 can be of different materials in order to give them desirable properties. By using a sunlight transparent foil, which is not transparent for heat radiation, it is possible to obtain a light shading against sunlight. Besides it is achieved an extra insulating during cold, cloudy, windy days without missing more light for this reason. A heat insulating at night is obtained too.

With a partly sunlight transparent foil, which can be metalized and for this reason reflecting resp. low emitting against heat radiation is obtained a great shading effect compared with the above.

Such a fabric can be suitable in hot countries to keep the heat outside the house effectively, or in other connections, where a very good heat insulation is desired.

A foil which is low emitting for all radiation can be used for heat insulation at night and for darkening at day.

One side of the foil strips (the under side) can be provided with a black layer absorbing heat radiation, while the upper side is metalized and above all with high reflecting.

To keep the fabric free from condensing drops on the underside this must on the first hand be kept warm. This is possible by making the upper side low-emitting and the underside absorbing. By arranging the threads closely on the underside and with extra thickness, this side can be compared with a textile material and can bind relatively large amounts of water capillary. By that condensing drops and a wet upperside are avoided, which if it becomes wet no longer is low emitting.

The advantages with such a fabric consisting of narrow strips compared to a continuous foil are many: it is more pliable and can be draped and rolled up, it is hot water, or diffusion tight and can be therefore not collect water vapour, it can be made very durable and it can be given a textile property on one side.

After that the fabric is manufactured it is preferably subjected to thermo fixation, of which it under tension is passed through a heat zone of about 150° C.

Figure 2:
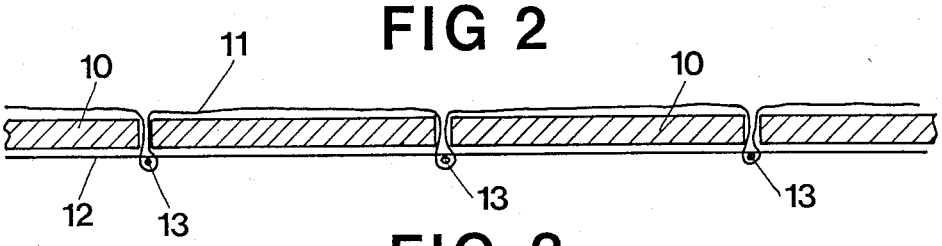
FIG. 2 shows on an enlarged scale and schematically a cross-section through a fabric according to FIG. 1.
Figure 4A:
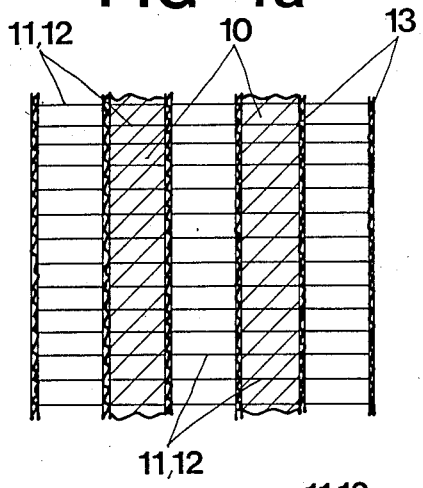
FIGS. 4*a*, 4*b* and 4*c* show different shading fabrics in accordance with the invention.
Figure 4B:
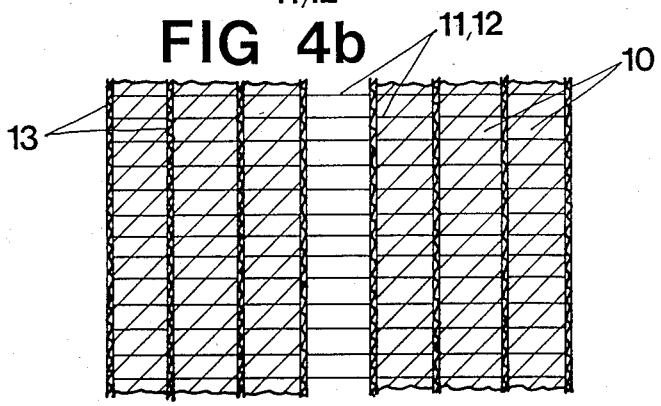
Figure 4C:
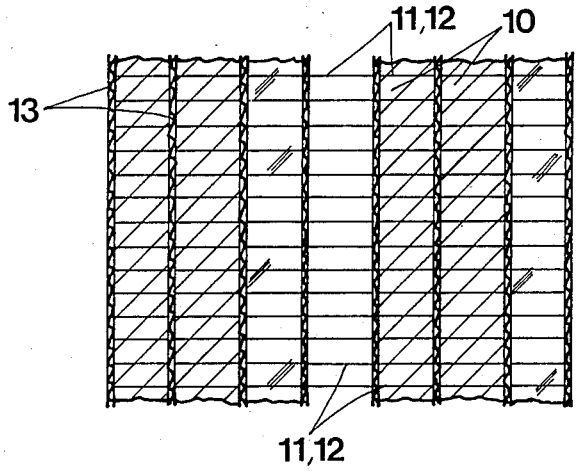

The greenhouse curtain fabrics shown in FIGS. 1–3 have the strips 10 located between each adjacent pair of longitudinal connection threads. FIG. 4*a* shows a shading fabric of generally similar structure to the previously described fabrics, but with strips 10 only in every other interval between adjacent rows of longitudinal connection threads. FIG. 4*b* shows a closer arrangement of strips 10 in groups of three, and FIG. 4*c* shows foil strips alternating with transparent plastic film strips and with ventilation gaps between adjacent groups of strips in intervals between selected pairs of longitudinal connection threads. The latter fabric may be used in cases where more light is desired. Some strips should, however, be metallic in order to have the desired reflectivity.

The fabric shown in FIGS. 4*a*, 4*b* and 4*c* are warp-knitted with longitudinal connection threads 13 in the form of so-called pillar stitches providing a very firm and unelastic structure keeping the strips in place. The longitudinal threads 13 are interconnected by closely arranged transverse connection threads (laid-in threads) in the same way as for the previously described greenhouse curtain fabrics.

The close yarn framework has a very high capacity of absorbing condensed water by capillary action (3-double threads in the stitches). Another important advantage is that the warp knitted fabric disclosed can be cut anywhere along its length or width without the edges needing to be trimmed.

While only preferred embodiments of the invention have been described herein in detail, the invention is not limited thereby and modifications can be made within the scope of the attached claims.

I claim:

1. A curtain fabric comprising spaced strips of a flexible sheet material running in one direction, a longitudinal direction, of the fabric and which are interconnected by means of textile threads in a yarn framework, the strips being selected from a group consisting of heat radiation reflecting and heat radiation absorbing materials, wherein the yarn framework includes transverse connection threads, and longitudinal connection threads, the transverse connection threads being located on opposite sides of a plane containing the strips so as to extend respectively across opposite surfaces of the strips, and the transverse threads on one side of said plane extending through the spaces between adjacent strips for connection to the longitudinal threads.

2. A curtain fabric according to claim 1 wherein the connection threads consist of a material which is capable of absorbing water by capillary action.

3. A curtain fabric according to claim 1 wherein the connection threads consist of a material which is heat shrinkable.

4. A curtain fabric according to claim 1 wherein the longitudional threads are located only on one side of the plane containing the strips.

5. A curtain fabric according to claim 1 wherein the connection threads on one side of the curtain are thinner than the threads on the other side.

6. A curtain fabric according to claim 4 wherein the thinner threads are made of a transparent material.

7. A curtain fabric acccording to claim 1 wherein one surface of each strip is metalized and low-emissive, and the other surface is heat absorbing.

8. A curtain fabric according to claim 1 wherein the strips consist of material which at least partly transmits light.

9. A curtain fabric according to claim 1 wherein the connection threads on one side of the fabric are closer together than on the other side.

10. A curtain fabric according to claim 1 in the form of a warp-knitted fabric in which the strips form the warp.

11. A curtain fabric according to claim 1 in the form of a woven fabric in which the strips form the warp and the transverse connection threads form the weft and in which reinforcing warp threads forming the longitudinal connection threads are located on one side of the fabric.

12. A curtain fabric according to claim 1 wherein the strips are located between each adjacent pair of longitudinal conection threads for use of the fabric as a greenhouse curtain.

13. A curtain fabric according to claim 1 wherein strip-free ventilation spaces are provided between selected pairs of adjacent longitudinal connection threads for use of the fabric as a shading fabric.

14. A curtain fabric as claimed in claim 13 wherein the strip-free spaces are bounded by groups of adjacent strips.

15. A curtain fabric as claimed in claim 14 wherein each group of strips includes a plastic strip.

16. A curtain fabric as claimed in claim 13 wherein the strips alternate with the strip-free spaces.

* * * * *